United States Patent [19]

Moline

[11] 4,155,458

[45] May 22, 1979

[54] LARGE TOOL SECURITY STORAGE SYSTEM

[76] Inventor: Brian F. Moline, c/o Richard N. Gentry, Jr., 1206 1st Natl. Bank Bldg., Peoria, Ill. 61602

[21] Appl. No.: 874,635

[22] Filed: Feb. 2, 1978

[51] Int. Cl.[2] ..... E05B 73/00

[52] U.S. Cl. ..... 211/4; 70/61; 211/59.1; 211/60 T

[58] Field of Search ..... 211/4, 60 R, 60 T, 60 SK, 211/64, 54.1, 57.1, 59.1, 94, 162; 70/59, 60, 61, 62; 206/372, 373; 312/DIG. 33

[56] References Cited

U.S. PATENT DOCUMENTS

| | | | |
|---|---|---|---|
| 839,298 | 12/1906 | Kitterman | 211/4 X |
| 1,186,649 | 6/1916 | Colson | 206/372 |
| 2,046,815 | 7/1936 | Fike | 70/61 |
| 2,754,974 | 7/1956 | Larson | 211/60 T X |
| 2,879,896 | 3/1959 | Green | 211/4 |
| 3,084,802 | 4/1963 | Ittner | 211/4 |
| 3,092,428 | 6/1963 | Kerschner | 206/373 X |
| 4,026,415 | 5/1977 | Sarley | 211/4 |
| 4,033,462 | 7/1977 | DeFabritis | 211/162 X |

FOREIGN PATENT DOCUMENTS

| | | | |
|---|---|---|---|
| 952340 | 10/1956 | Fed. Rep. of Germany | 211/60 T |
| 1125843 | 9/1968 | United Kingdom | 211/4 |

*Primary Examiner*—Thomas J. Holko

*Attorney, Agent, or Firm*—Clarence A. O'Brien; Harvey B. Jacobson

[57] ABSTRACT

A horizontally elongated support structure is provided for attachment to one side of an upstanding toolbox and supports a plurality of horizontally outwardly projecting support members spaced therealong over which the upper end portions of large upstanding tools may be telescoped for support of the tools therefrom and removal of the tools endwise outwardly of the outer extremities of the support members. An upstanding panel member including a lower marginal edge portion is provided and the lower marginal edge portion of the panel member is pivotally supported from the toolbox side for angular displacement about a horizontal axis, whereby the upper end of the panel member may be swung toward and away from the portion of the toolbox. The upper marginal portion of the panel member defines horizontal openings therethrough through which the outer extremities of the support members project and lock structure is provided for releasably locking at least one of the outer extremities of the support members through the corresponding opening. If the panel member is of a vertical extent less than the vertical extent of the tools to be supported from the support structure, the lower end of the panel member may have an opening formed therethrough through which to receive the lower ends of the supported tools.

10 Claims, 4 Drawing Figures

LARGE TOOL SECURITY STORAGE SYSTEM

BACKGROUND OF THE INVENTION

Many mechanics have a considerable investment in hand tools and utilize lockable tool cabinets in which to store their tools when they are not being used, thereby providing security for the tools when the mechanics are not at work.

However, many mechanics occasionally use tools which are too great in length to be received within conventional toolboxes or cabinets commonly in use. Accordingly, these long tools must often be left unsecured against theft. Therefore, a need exists for a security storage system for use in conjunction with long tools and which may be operatively associated with a conventional tool cabinet.

Various forms of tool and article support racks have been heretofore provided with different structures for locking tools and articles thereon. Examples of previously known forms of tool and article racks including some of the general structural and operational features of the instant invention are disclosed in U.S. Pat. Nos. 839,298, 1,914,276, 2,572,797, 2,577,988, 2,754,974 and 3,279,620.

BRIEF DESCRIPTION OF THE INVENTION

The large tool security system of the instant invention is adapted to be utilized in conjunction with a conventional tool cabinet. The tool security storage system is operative to support various tools therefrom which are too long or otherwise too large to be received within conventional tool cabinets of the type utilized by mechanics. The storage system includes a horizontally elongated support structure for support from the side of the tool cabinet and including a plurality of horizontally outwardly projecting support members supported therefrom, spaced therealong and shiftable into position along the support structure. The outer extremities of the support members are adapted to have the upper portions of large upstanding tools telescoped thereover for support therefrom and from which the tools may be removed upon displacement endwise outwardly of the outer extremities of the support members and an upstanding panel member is provided including a lower marginal edge portion for pivotal support from the associated toolbox side and an upper marginal edge portion swingable toward and away from that portion of the associated toolbox side from which the elongated support structure is supported. The upper marginal portion of the panel member defines horizontal openings therethrough through which the outer extremities of the support members project and structure is provided for releasably locking at least one of the outer extremities of the support members through the corresponding opening.

The main object of this invention is to provide a security storage system for securing large tools on the side of a toolbox.

Another object of this invention is to provide a storage system in accordance with the preceding object and which may be readily mounted on the side of various forms of tool cabinets.

Still another object of this invention is to provide a large tool security system which will be capable of securing large tools of many different forms against theft.

A further object of this invention is to provide a security storage system which may be readily adjusted to receive a plurality of different forms of long tools.

A final object of this invention is to provide a large tool security storage system for use in conjunction with a toolbox in which long tools may not be received for security storage and a security storage system which will conform to conventional forms of manufacture, be of simple construction and easy to use, so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
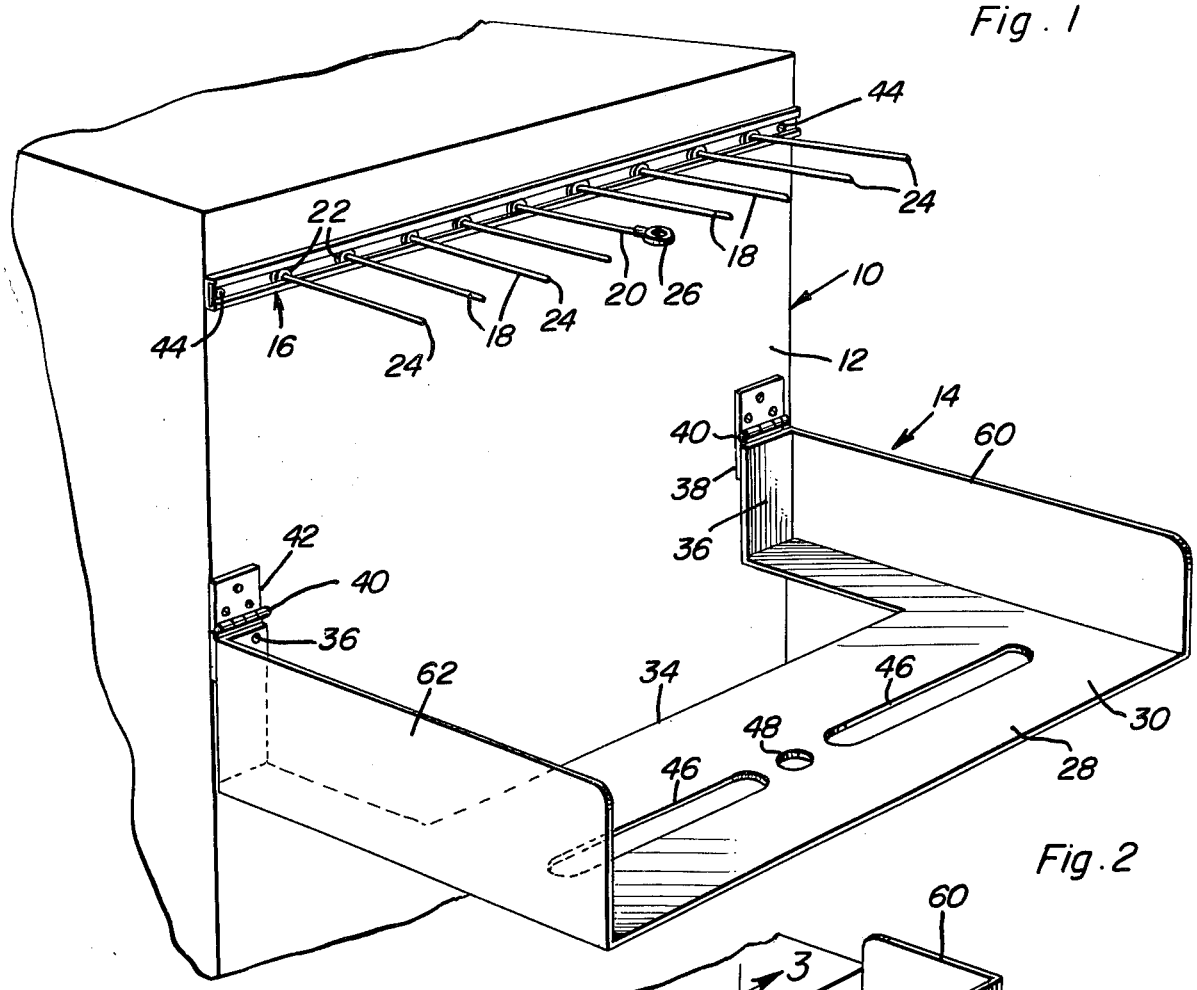
FIG. 1 is a fragmentary perspective view of one side of a toolbox with the security storage system of the instant invention operatively mounted on the toolbox and the storage system in an unlocked condition.

Referring now more specifically to the drawings, the numeral 10 generally designates a conventional form of tool cabinet including an upstanding side wall 12. The tool cabinet 10 includes lockable compartments (not shown) in which small and even medium-sized hand tools may be received and locked in a secure manner. However, large tools which are often used by mechanics are many times too great in length or otherwise too large to be received within lockable compartments of a tool cabinet, such as the tool cabinet 10.

The large tool security storage system of the instant invention is referred to in general by the reference numeral 14 and includes an elongated horizontal support structure referred to in general by the reference numeral 16. The support structure 16 comprises an open ended horizontally outwardly opening channel member and a plurality of support pegs or support members 18 and 20 which pegs include slide followers 22 on one set of corresponding ends thereof slidingly received within the channel member 16. The other set of corresponding ends of the pegs or support members 18 and 20 project outwardly through the open side of the channel member 16 and include outer terminal ends 24 and 26. The followers 22 are cylindrical in configuration and accordingly, the pegs or support members 18 and 20 may be rolled as well as slid along the channel-shaped support structure 16. Of course, the followers 22 may be inserted into the channel member 16 through the opposite ends thereof.

Figure 2:
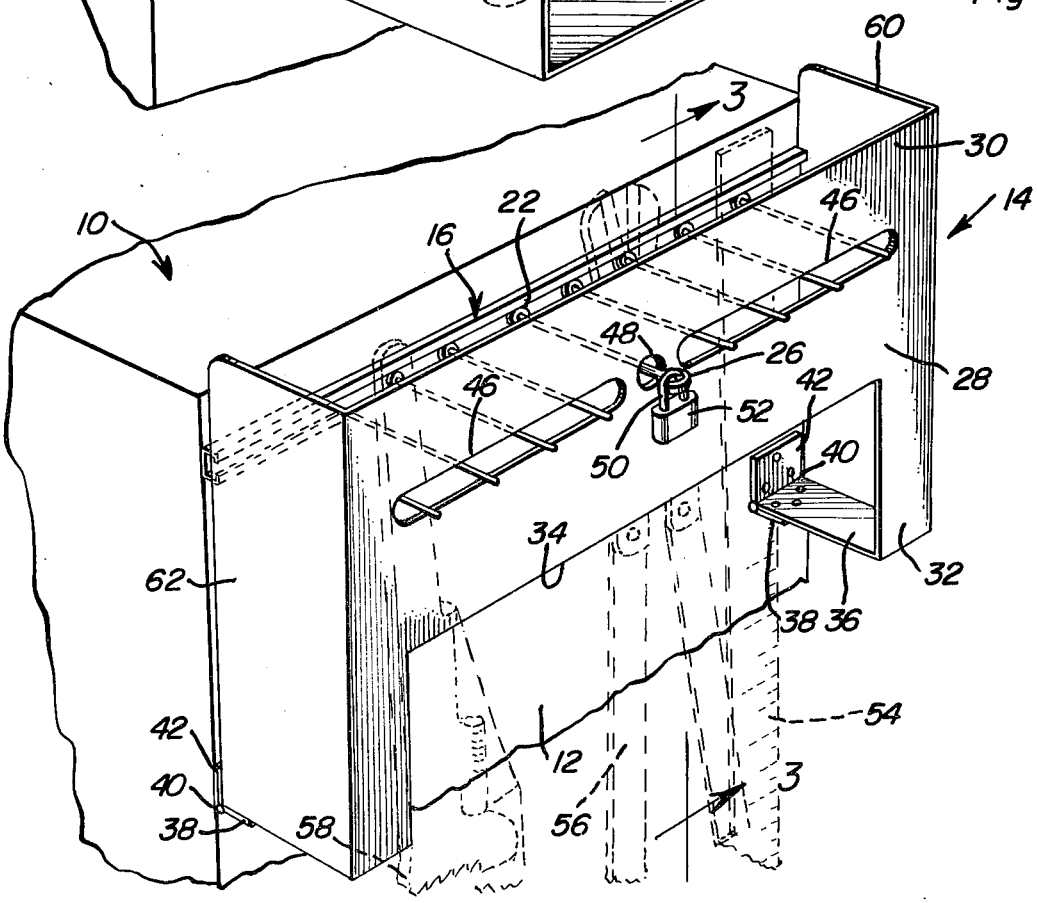
FIG. 2 is a fragmentary perspective view similar to FIG. 1 but illustrating the security storage system in a locked condition.
Figure 3:
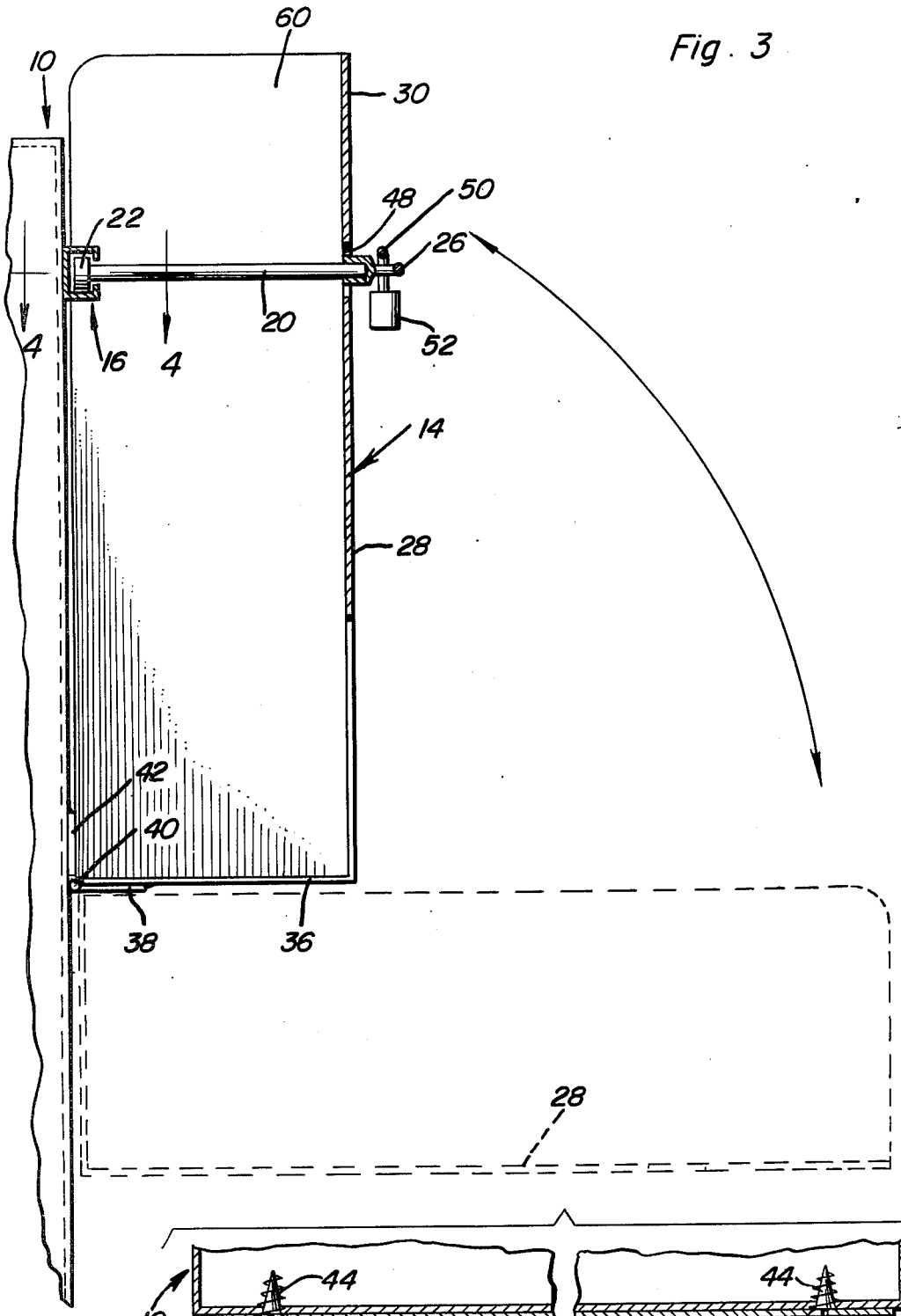
FIG. 3 is an enlarged fragmentary vertical sectional view taken substantially upon the plane indicated by the section line 3—3 of FIG. 2.
Figure 4:
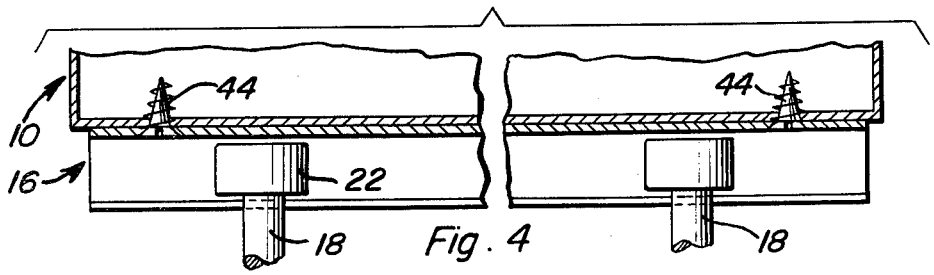
FIG. 4 is an enlarged fragmentary horizontal sectional view taken substantially upon the plane indicated by the section line 4—4 of FIG. 3.

The storage system 14 further includes a panel member 28 which is illustrated in FIG. 2 in upstanding position. The panel member 28 includes upper and lower marginal edge portions 30 and 32 and the lower marginal edge portion 32 includes a downwardly opening recess 34 formed therein. Those portions of the lower marginal edge portion 32 on opposite sides of the recess 34 terminate downwardly in inturned arms 36 having corresponding leaves 38 of hinges 40 secured thereto and the hinges 40 include second leaves 42 which are secured to the side wall 12 below the upper marginal edge portion thereof from which the channel member 22 is supported.

The leaves 38 are secured to the arms 36 in any convenient manner such as by spot welding and the leaves 42 may be secured to the side wall 12 of the cabinet 10 in any convenient manner such as by fasteners secured through the leaves 42 and the side wall 12. In addition, the opposite end portions of the channel member 16 are secured to the side wall 12 of the cabinet 10 by means of fasteners 44.

Inasmuch as the arms 36 are spaced apart, the recess 34 defines an opening in the panel member portion of the security storage system 14 which opens both horizontally outwardly away from the side wall 12 and which also open downwardly.

The upper marginal edge portion 30 of the panel member 28 includes openings 46 and 48 formed therethrough and the outer extremities 24 and 26 of the support members or pegs 18 and 20 are receivable through the openings 46 and 48 when the panel member 28 is in the vertical position thereof illustrated in FIG. 2 of the drawings. The outer extremity 26 of the support member 20 defines a horizontal eye through which the hasp 50 of a padlock 52 may be passed in order to lock the panel member 28 against movement away from the side wall 12 of the cabinet 10.

When it is desired to lock long or otherwise large tools in a secure manner, the lock 52 is removed and the panel member 28 is swung to the horizontal position thereof with the arms 36 abutted against the outer side of the side wall 12. With the panel member 28 thus shifted to an open position, the recess 34 defines a vertical opening extending through the panel member 28 and a plurality of different long tools 54, 56 and 58 may have their upper end portions telescopingly engaged over the pegs or support members 18. Thereafter, the panel member 28 may be swung back to the closed vertically disposed position thereof illustrated in FIG. 2 of the drawings with the free ends of the pegs or support members 18 and 20 projected through the openings 46 and 48. Then, the hasp 50 of the lock 52 may again be passed through the eye 26 in order to lock the panel member 28 against swinging movement of the upper end thereof away from the side wall 12.

The opposite side vertical marginal edge portions of the panel member 28 include inturned vertical side flanges 60 and 62 which substantially abut against the side wall 12 of the cabinet 10 when the panel member 28 is in the locked vertical position thereof illustrated in FIG. 2 of the drawings. When the panel member 28 is in the vertical position of FIG. 2, the flanges 60 and 62 close the ends of the channel member 16 and rigidify the panel member 28 preventing the upper corners thereof from being pried away from the side wall 12 of the cabinet 10. Of course, inasmuch as the upper ends of the tools 54, 56 and 58 are telescoped over the pegs or support members 18 and 20, they may not be removed therefrom unless they are withdrawn from the outer ends of the pegs or support members 18 and 20. Thus, when the panel member 28 is in the closed position thereof illustrated in FIG. 2 of the drawings with the terminal ends 24 and 26 of the pegs 18 and 20 projecting through the openings 46 and 48, the tools 54, 56 and 58 may not be removed from the pegs. In addition, the openings 46 and 48 have little vertical extent in order to prevent the support members 18 and 20 from being bent up or down so as to pass the free ends thereof through the openings 46 and 48. Although the openings 46 are horizontally elongated, each opening 46 may be replaced by four circular openings such as the opening 48 in order to effectively prevent bending of the pegs or support members 18 in any direction. Also, although the terminal end or eye 26 of the support member 20 has been illustrated only to support the hasp 50 of the padlock 52, it is to be noted that a long tool may also be supported from the peg or support member 20.

Inasmuch as the pegs 18 and 20 may be shifted longitudinally of the channel member 16, the spacing between the pegs 18 and 20 may be varied as desired in order to accommodate different large tools in side-by-side relation. Also, the channel member 16, pegs 18 and 20 and the panel member 28 may be constructed of a sufficiently large gauge of metal to effectively discourage all but the most serious attempts at theft of the tools 54, 56 and 58.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A large tool security storage system for use on an upstanding support surface, said system including a horizontally elongated support structure for support from said surface, said support structure including a plurality of horizontally outwardly projecting support members spaced therealong and adapted to have the upper portions of large upstanding tools supported therefrom for removal endwise outwardly of the outer extremities of said support members, and an upstanding panel member including a lower marginal edge portion for pivotal support from said support surface below said support structure for angular displacement about a generally horizontal axis, the upper marginal portion of said panel member defining horizontal openings therethrough through which said outer extremities project, means releasably locking at least one of said outer extremities through the corresponding opening, said lower marginal edge portion including opposite end horizontally spaced apart arms projecting outwardly from one side of said panel member, the outermost ends of said arms including hinge means for hingedly supporting said panel member from said support surface, said lower marginal edge portion, between said arms, defining a downwardly opening recess which, together with the horizontal spacing between said arms, defines a single opening through which to receive the lower ends of long upstanding tools supported from said support members, whether said panel member is in an upstanding position or a horizontal position.

2. The combination of claim 1 wherein at least one of said openings is horizontally elongated and receives a plurality of said support members therethrough and other of said openings closely receives the corresponding support member therethrough.

3. The combination of claim 2 wherein the outer extremity of the last mentioned support member defines an integral eye member through which to removably receive a locking member.

4. The combination of claim 1 wherein said elongated support structure defines an elongated channel member, said support members including followers slidingly received in said channel member for shifting longitudinally therealong.

5. The combination of claim 4 wherein said followers comprise cylindrical members rollingly received in said channel member.

6. In combination with an upstanding support surface, a security storage system for long upstanding tools, said system including a horizontally elongated support structure supported from said surface, said support structure including a plurality of horizontally outwardly projecting support members spaced therealong and adapted to have the upper portions of large upstanding tools supported therefrom for removal endwise outwardly of the outer extremities of said support members, an upstanding panel member including a lower marginal edge portion pivotally supported from said support surface below said support structure for angular displacement about a generally horizontal axis paralleling said surface, the upper marginal portion of said panel member defining horizontal openings therethrough through which said outer extremities project, means releasably locking at least one of said outer extremities through the corresponding opening, said lower marginal edge portion including opposite end horizontally spaced apart arms projecting outwardly from one side of said panel member, the outermost ends of said arms including hinge means hindgedly supporting said panel member from said support surface, said lower marginal edge portion, between said arms defining a downwardly opening recess which, together with the horizontal spacing between said arms, defines a single opening through which to receive the lower ends of long upstanding tools supported from said support members, whether said panel member is in an upstanding position or a horizontal position.

7. The combination of claim 6 wherein at least one of said openings is horizontally elongated and receives a plurality of said support members therethrough and other of said openings closely receives the corresponding support member therethrough.

8. The combination of claim 6 wherein the outer extremity of the last mentioned support member defines an integral eye member through which to removably receive a locking member.

9. The combination of claim 6 wherein said lower marginal edge portion includes opposite end horizontally spaced apart arms projecting outwardly from one side of said panel member, the outermost ends of said arms including hinge means hingedly supporting said panel member from said support surface, said panel member including upstanding opposite side flanges projecting outwardly of said one side thereof and closely opposing said surface when said panel member is in an upstanding position with said support members projecting through said openings.

10. In combination with an upstanding support surface, a security storage system for long upstanding tools, said system including at least one horizontally outwardly projecting support member supported and projecting outwardly from said surface and adapted to have the upper portion of a large upstanding elongated tool supported therefrom for removal endwise outwardly of the outer extremity of said support member, an upstanding panel member including a lower marginal edge portion pivotally supported from said support surface below said support member for angular displacement about a generally horizontal axis paralleling said support surface, the upper marginal portion of said panel member defining a horizontal opening therethrough through which said outer extremity of said support member projects, said lower marginal edge portion of said panel member including opposite end horizontally spaced apart arms projecting outwardly from one side of said panel member toward said support surface, the outermost ends of said arms including hinge means defining the structure by which said panel member is pivotally supported from said support surface, said lower marginal edge portion between said arms defining a downwardly opening recess which, together with the horizontal spacing between said arms defines a single opening through which to receive the lower end of a long upstanding tool supported from said support member, whether said panel member is in an upstanding position or a horizontal position, and means connected between said panel member and said support surface for releasably securing said panel member in an upstanding position with said support member having its outer extremity received through said horizontal opening.

* * * * *